United States Patent [19]

Wilkinson

[11] Patent Number: 5,007,632

[45] Date of Patent: Apr. 16, 1991

[54] COMBINATION SIT-UP, ROWING, ARM, LEG AND FOOT EXERCISE DEVICE

[76] Inventor: William T. Wilkinson, P.O. Box 378, Chesapeake City, Md. 21915

[21] Appl. No.: 420,375

[22] Filed: Oct. 12, 1989

[51] Int. Cl.[5] ..... A63B 69/06; A63B 21/04

[52] U.S. Cl. ..... 272/72; 272/126; 272/136; 272/142

[58] Field of Search ..... 272/72, 73, 96, 130, 272/132, 134, 136, 142, DIG. 4, 126

[56] References Cited

U.S. PATENT DOCUMENTS 1,275,757 8/1918 Rosenberg ..... 272/134
3,902,717 9/1975 Kulkens ..... 272/142 X
4,705,267 11/1987 Jackson ..... 272/72 X

FOREIGN PATENT DOCUMENTS

87/07167 12/1987 World Int. Prop. O. ..... 272/72

*Primary Examiner*—Robert Bahr
*Attorney, Agent, or Firm*—Charles S. Knothe

[57] ABSTRACT

A combination sit-up, rowing, arm, leg and foot exercise device which includes a center pole, seat with rocker legs and telescoping legs, caster/wheel assembly, stationary or movable foot cross pole, foot treadles, seat cross pole and seat back support. Springs or other resistance devices are connected to the device at various locations to create resistance.

19 Claims, 8 Drawing Sheets

COMBINATION SIT-UP, ROWING, ARM, LEG AND FOOT EXERCISE DEVICE

BACKGROUND

Fitness and exercise have become very important during the recent years. Many devices are available to assist people in this quest. Two popular forms of fitness exercise are sit-ups and rowing. Currently there is a device for sit-ups consisting of a seat with hand grips on the side. The seat is curved on the bottom to allow for a rocking motion while doing sit-ups. This device however has little or no support for the back and head.

Most devices perform only a single function. Thus, if an individual wants to obtain total fitness many devices are necessary at great expense and space requirements. Some of the devices available are for sit-ups, rowing action, arm and shoulder development, leg and foot exercise. An object of this invention is to provide an exercise device that performs these functions at an economical price.

One of the exercises this invention can be used for is to perform sit-ups. It allows for a seat back extending beyond the seat to provide for back support while doing sit-ups. The seat back allows for varying angles of back support. Three types of sit-ups are available: the user can obtain assistance from the device, obtain no assistance and only use the natural gravitational force or use the device as a resistance device for even greater physical development. This adjustable angle and adjustable tension allow the user to perform a program of assisted sit-ups to a progressively more difficult sit-up.

The invention provides for rowing exercise. Concurrent with the rowing exercise the device provides for exercise of the legs and feet. A further object of this invention is to allow for the exercise of the arms.

SUMMARY OF INVENTION

This invention is a combination sit-up, rowing, arm, leg, and foot exercise device. The device contains a center pole with front and rear ends and top and bottom surfaces having a plurality of holes along the top surface and a corresponding plurality of holes along the bottom surface. Rigidly attached to the center pole is a seat with a front edge, two side edges, rear edge, top and bottom surfaces. To each side edge of the seat is rigidly mounted a seat spring catch. Two seat rocker legs are attached to the bottom surface of the seat and two retractable legs are mounted perpendicularly to the seat bottom surface.

The device has seat back with a bottom edge and a top edge. The bottom of the seat back is mounted to the rear edge of the seat with a hinge joint. Removably connected to the top edge of the seat back is a seat cross pole with two ends, and attached to each end of the rear seat cross pole is a seat cross pole spring catch. Two sit-up assist springs each with two ends, each end having a hook are used. One hook of the sit-up assist spring engages the seat catch and the other hook engages the corresponding seat cross pole catch. A rear accessory catch is rigidly mounted to the back of the seat back.

The foot cross pole bracket engages the center pole such that the foot cross pole bracket may transverse along the center pole in the lengthwise direction. The device has a foot cross pole with two ends. The foot cross pole is rigidly attached to the foot cross pole bracket such that the foot cross pole is perpendicular to the center pole. Also, the foot cross pole bracket has a foot cross pole bracket spring catch rigidly mounted to it. A foot cross pole bracket rigidly locks the foot cross pole bracket to the center pole using one of the holes in the top and bottom surface of the center pole. A center foot cross pole spring catch is rigidly mounted to the foot cross pole bracket and a center pole spring catch is removably mounted to the center pole using one of the plurality of holes contained in the center pole between the seat and the foot cross pole bracket. A leg spring is attached to the center pole spring catch and the center foot cross pole spring catch.

Two foot treadles with top and bottom ends are pivotably mounted to the foot cross pole. Attached on the bottom end of the foot treadle is a foot treadle spring catch. Two foot pedal tension springs each with two ends, each end having a hook, one hook engages the front leg spring catch and the other hook engages each foot treadle spring catch. Further, a front caster/wheel assembly is mounted to the center pole at the front end of the center pole and a front leg spring catch is mounted to the front caster assembly.

The device has two arm springs each with two ends, one end having a hook and the other end having a handle for grasping. The hook end of the arm spring engages the corresponding foot cross pole spring catch.

The rear support bracket is removably attached to the center pole and a rear support catch and lock secures the rear support bracket to the center pole using the holes in the center pole. The seat support arm attaches to the rear accessory catch and the rear support bracket.

Two seat back springs are mounted to the seat spring catch at one end and at the other end mounted to the rear support lock and spring catch. A body belt consisting of two sections with a means to connect them are mounted to the seat back and two rear arm tension springs are attached to the rear support lock and spring catch.

DESCRIPTION OF THE PREFERRED EMBODIMENT

Figure 1:
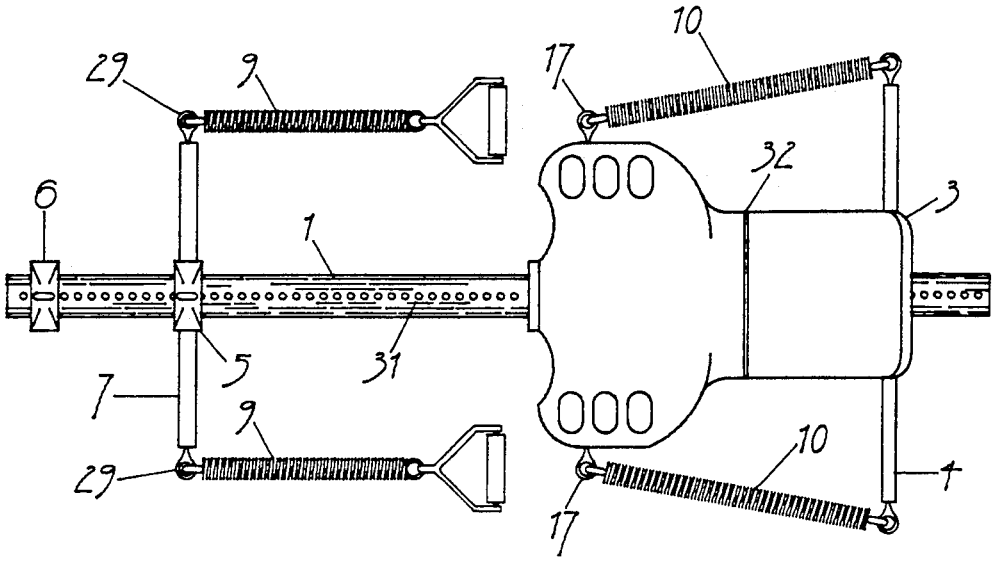
FIG. 1 is a top view of the device with two rowing springs with separate handles.

FIG. 1 shows the center pole 1 containing a plurality of holes 31 used for the adjustment and locking of the accessories used with this exercise device. The seat 2 is rigidly attached to the center pole 1 such that there is adequate length in front of the seat for a person using the device to sit comfortably on the seat with their feet on the foot cross pole 7. The foot cross pole 7 is attached to the center pole 1 by means of a foot cross pole bracket 5. The caster assembly 6 is mounted to the center pole 1 at the front end of the center pole 1. A seat spring catch 17 is rigidly mounted to each side edge of the seat 2.

Figure 2:
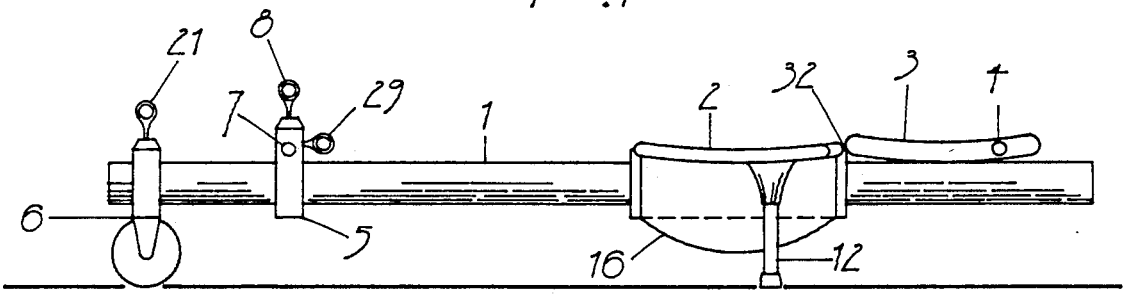
FIG. 2 is a side view of the device with the seat back in the reclining position.
Figure 13:
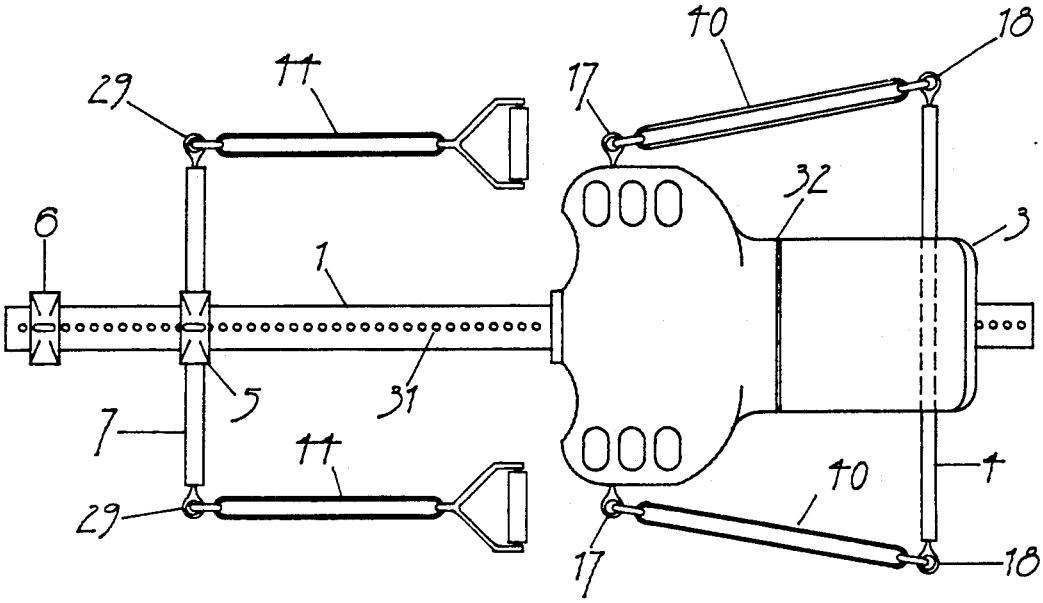
FIG. 13 is a top view of the device with two rowing elastic cords with separate handles.

In FIG. 2 the device is shown with the seat back 3 in the reclining position. The seat back 3 is attached to the seat 2 by means of the hinge 32. The hinge 32 allows the seat back 3 to articulate. When the invention is used as a sit-up device the sit-up assist elements 10 as shown in FIG. 1, assist the exerciser in doing sit-ups. In FIG. 1 the sit-up assist elements 10 are shown as springs but these elements can also be sit-up assist elastic cords 40 as shown in FIG. 13. FIG. 2 also depicts the retractable legs 12. The user of the invention can either allow the device to sit on the seat rocker legs 16 or upon retractable legs 12. The seat rocker legs 16 allow the device to rock much as a rocking chair during sit-ups. The retractable legs 12 allow the device to remain in a fixed position during exercise. Also, depicted in FIG. 2 are the holes in the center pole 1. This view shows the hole through the corresponding upper and lower surfaces of the pole. These holes allow for full adjustment of the accessories along the entire length of the pole. Also, attached to the center pole 1 is the foot cross pole bracket 5. This bracket is used to hold the foot cross pole 7, as shown in the end view in FIG. 2. The front caster assembly 6 is attached to the center pole 1 at the front end.

Figure 3:
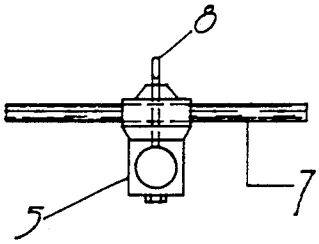
FIG. 3 is a fragmentary view of the seat mounted to the center pole.

The foot cross pole 7 is shown mounted to the foot cross pole bracket in FIG. 3. This figure also shows the aperture in the foot cross pole bracket 5 through which the center pole passes. The foot cross pole bracket lock 8 affixes the foot cross bracket 5 to the center pole at the desired location. The preferred embodiment of the foot cross bracket lock is a threaded bolt and nut such that the bracket is securely fastened to the pole during use.

Figure 4:
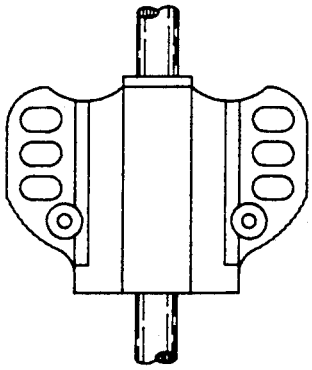
FIG. 4 is front view of the foot cross pole and foot cross pole bracket.

FIG. 4 is a fragmentary view of the bottom of the seat 2. This view shows the hand holes 33 in the seat. These holes are used during sit-ups by the person exercising to place their hands through the seat for better stability. Attached to the bottom of the seat are two seat rocker legs 16. Also, attached to the bottom of the seat are the two retractable legs 12.

Figure 5:
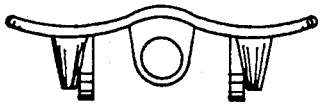
FIG. 5 is a front view of the seat.

FIG. 5 is a front view of the seat 2 showing the location of the two rocker legs 16 and the two retractable legs 12 attached to the bottom of the seat 2.

Figure 6:
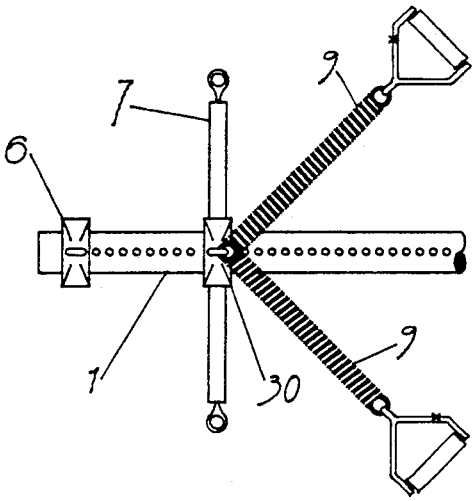
FIG. 6 is a fragmentary view of the center pole with two rowing springs attached to the foot cross pole catch.
Figure 14:
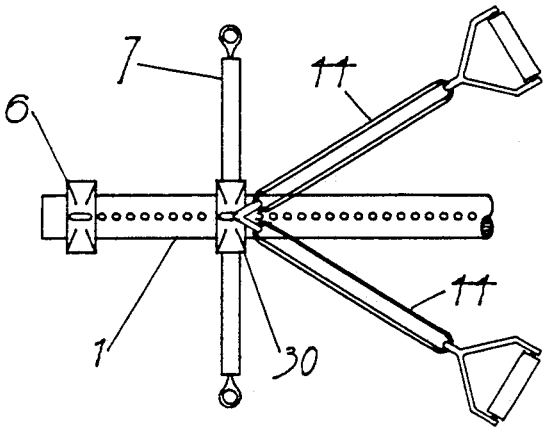
FIG. 14 is a fragmentary view of the center pole with two rowing elastic cords attached to the foot cross pole catch.
Figure 20:
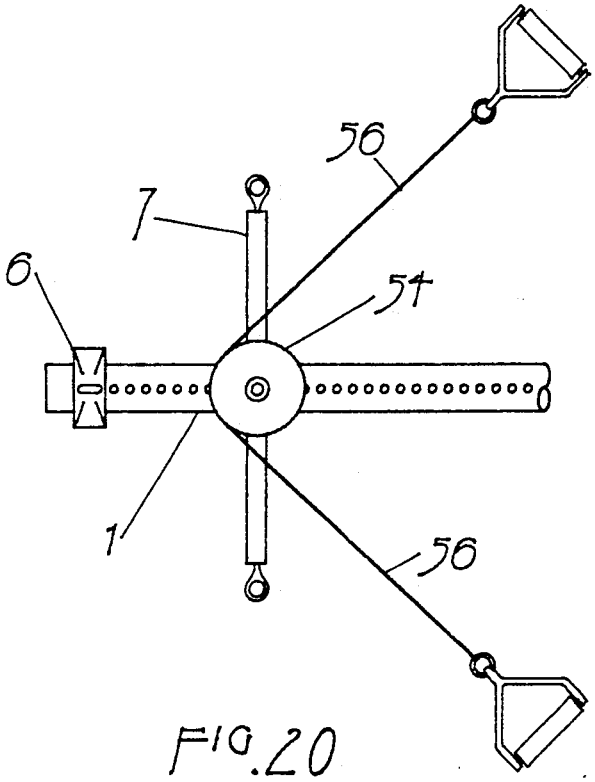
FIG. 20 is a fragmentary view of the center pole with the front pulley and cable attached to the foot cross pole catch.

An alternative method of connecting the rowing tension elements 9 is shown in FIG. 6. The rowing tension elements 9 are shown in FIG. 6 as springs but an alternate embodiment of this invention shows rowing tension elements as elastic cords 44 in FIG. 14. A further alternate embodiment of this invention is shown in FIG. 20 wherein front pulley 54 and front cable 56 are used. In this alternate method 1 or 2 rowing springs are attached to the center foot cross pole spring catch 30, rather than to the spring catch 29 as shown in FIG. 1. In either method overhead or side rowing can be done. Different levels of resistance can be achieved by the changing of the location of the center cross pole catch 30 in FIG. 6 or the spring catch 29 in FIG. 1.

Figure 7:
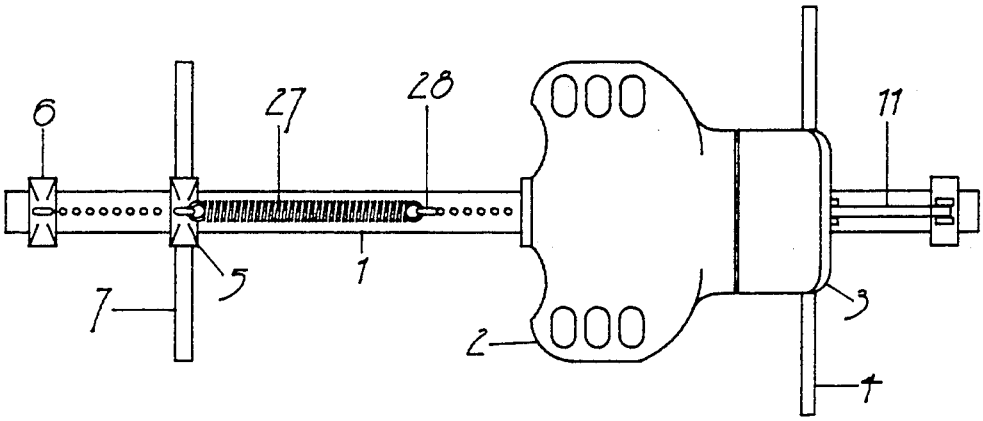
FIG. 7 is a top view of the device wherein the foot pole bracket is connected to the leg spring and transverses along the center pole.
Figure 15:
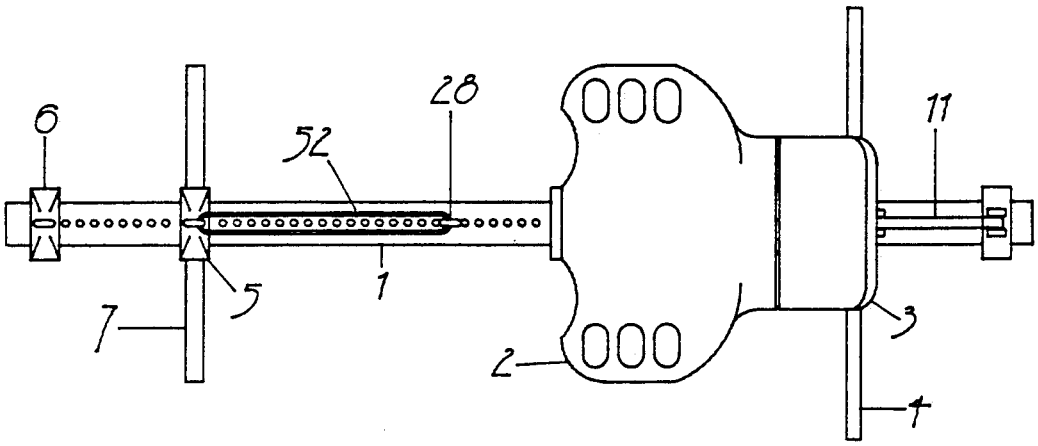
FIG. 15 is a top view of the device wherein the foot pole bracket is connected to the leg elastic cord and transverses along the center pole.

The use of the invention to exercise the legs is shown in FIG. 7. Herein the foot cross bracket 5 is allowed to slide along the center pole 1 by not using any locking devices. Attached to the cross foot pole bracket 5 using the center foot cross pole spring catch 30 is the leg tension element 27. The other end leg tension element 27 is connected to the center pole spring catch 28, which is securely fixed to the center pole 1. Therefore the person exercising can flex their leg muscles by placing their feet on the foot cross pole 7 and stretching the leg tension element 27. The leg tension element 27 is shown as a spring in FIG. 7 but an alternate embodiment of this invention as shown in 52 of FIG. 15 uses an elastic cord. This exercise can be done concurrent with the rowing exercise using some of the other features of this invention. The amount of spring tension can be adjusted by selecting different holes in center pole 1 for the mounting of the center pole spring catch 28. FIG. 7 also shows the seat back support arm 11, which supports the seat back 3 while the individual is exercising and exerting force against the seat back.

Figure 8:
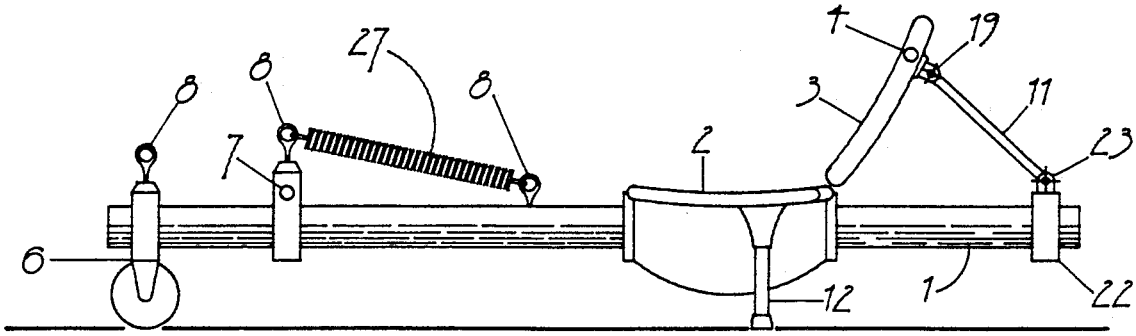
FIG. 8 is a side view of the device with the retractable legs and the rear support bracket.

The seat back support 11 in FIG. 8 is shown connected to the rear seat accessory latch 19 at one end and to the rear support lock and spring catch 23 at the other end. The rear support bracket 22 is affixed to the pole 1 by means of the rear support lock and spring catch 23. The seat back support arm 11 stops the seat back 3 from tilting when the individual exercising rests against the seat back. FIG. 8 also shows the device wherein the foot cross pole 7 and foot cross pole bracket 8 can reciprocate along center pole 1 and are given resistance by leg spring 27.

Figure 9:
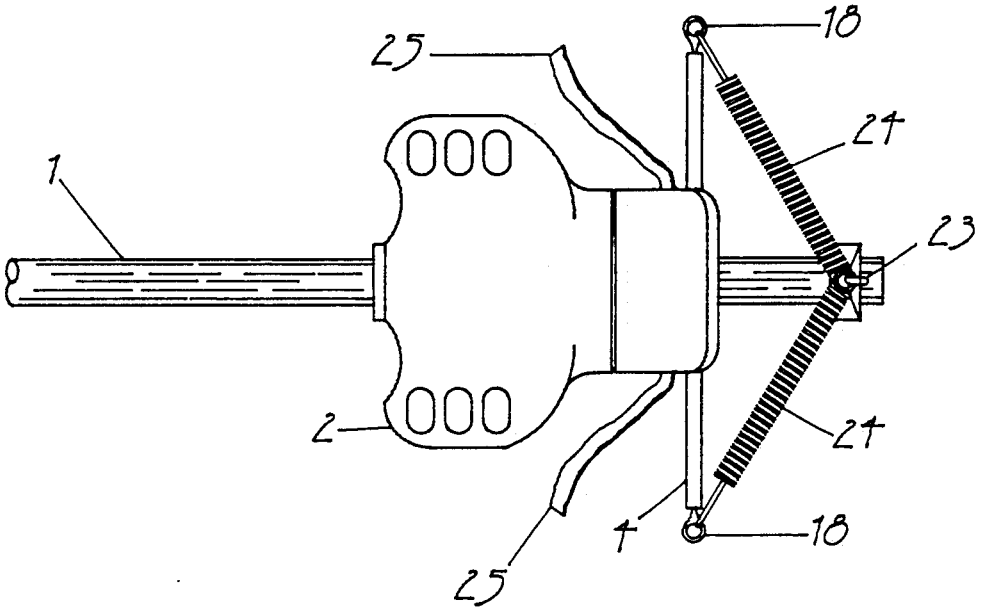
FIG. 9 is a fragmentary top view of the seat and center pole with the rear seat tension springs and body belt.
Figure 10:
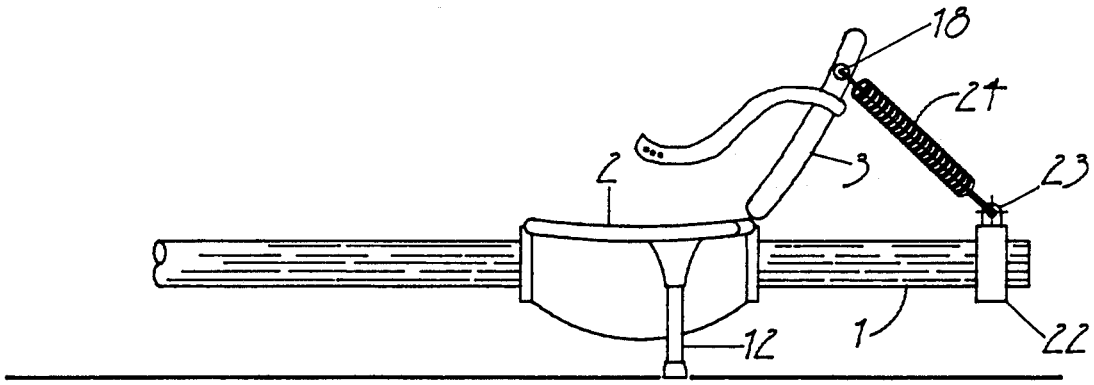
FIG. 10 is a fragmentary side view of the seat and center pole with the rear seat tension springs and body belt.
Figure 18:
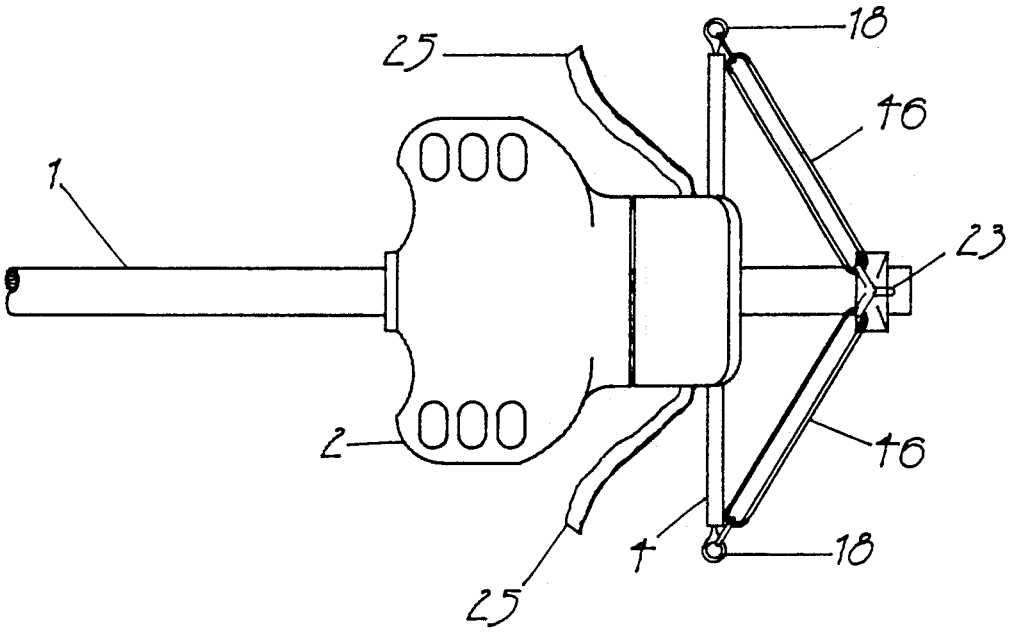
FIG. 18 is a fragmentary top view of the seat and center pole with the rear seat tension elastic cords and body belt.

Another exercise capability of the invention is shown in FIG. 9, wherein seat back tension element 24 are connected to rear support lock and spring catch 23 at one end and seat cross pole spring catch 18 at the other end. In FIG. 9 the seat back tension element is a spring but an alternate embodiment of this invention as shown in FIG. 18 this element is an elastic cord. In this configuration the exerciser straps himself to seat 2 by use of the body straps 25 and uses the resistance of the back seat springs 24 during sit-up exercises. When the exerciser uses this configuration he can place his feet under the foot cross pole 7 as shown in FIG. 1 to obtain the necessary leverage necessary to perform a sit-up. An alternative way of doing sit-ups by use of the seat back spring 24 is for the exerciser to wrap his arms around the seat cross pole 4 rather than to use the body strap 25. In FIG. 10 the seat back 3 is shown hinged to the seat 2 by means of the hinge 32. The seat back 3 is held in the down position of seat back spring 24. The seat back 24 is fixed at one end to the rear support lock and spring catch 23 and the seat cross pole spring catch 18 at the other end. The exerciser uses this configuration to increase the resistance during sit-ups and can either use the body strap 25 around his body or wrap his arms around the seat cross pole 4 as shown in FIG. 9.

Figure 11:
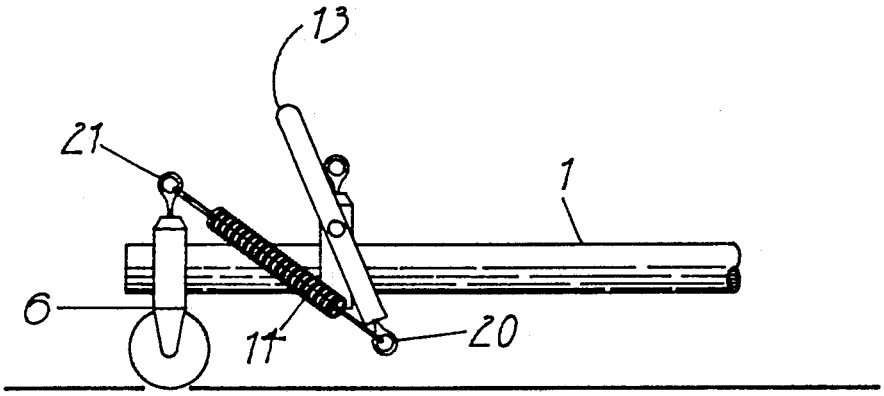
FIG. 11 is a fragmentary side view of the foot cross pole and foot treadles.
Figure 16:
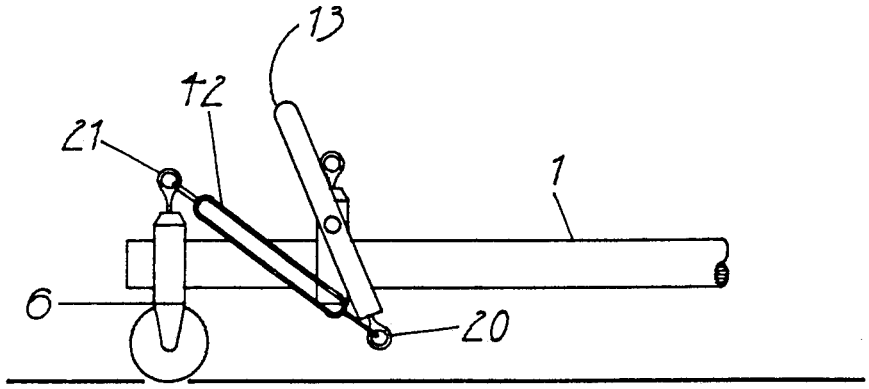
FIG. 16 is a fragmentary side view of the foot cross pole and foot treadles with an elastic cord.

FIG. 11 is a fragmentary view showing another exercise feature of the device, wherein a foot treadle 13 is rotatably attached to the foot cross pole 7. Resistance is added to the foot treadle by the foot treadle tension element 14 which is attached at one end to the foot treadle spring catch 20 and at the other end to the front caster lock and spring catch 21. Therefore, the exerciser obtains development by pushing on the upper portion of the foot treadle 13 while rowing or performing leg exercises as herein before described. The amount of effort which is required can be adjusted by moving the position of the foot cross pole 7 along the center post 1. The foot treadle tension element 10 is shown in FIG. 11 as a spring but an alternate embodiment of this invention uses a foot treadle elastic cord 42 as shown in FIG. 16.

Figure 12:
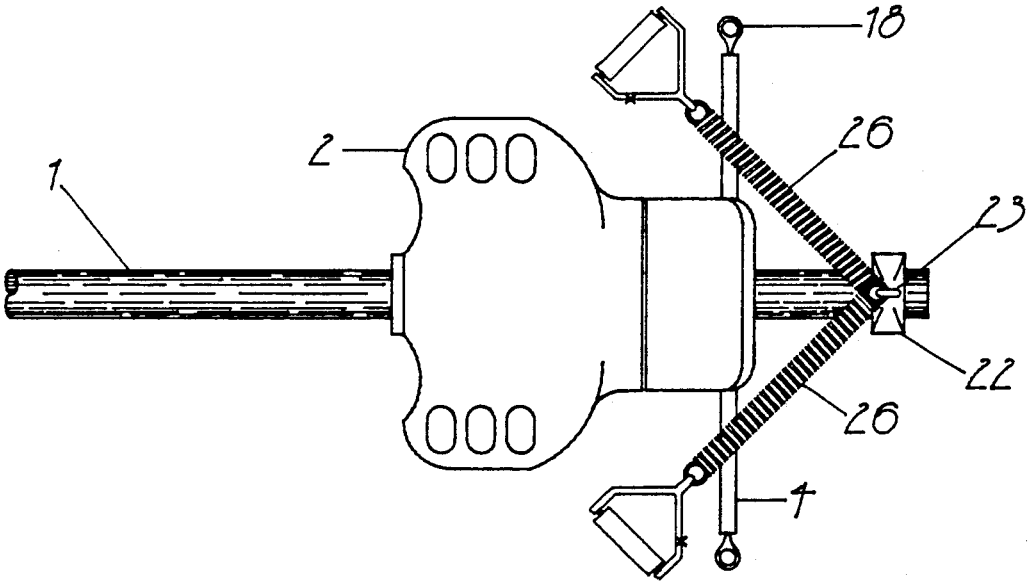
FIG. 12 is a fragmentary top view of the seat and center pole with the rear arm tension springs.
Figure 17:
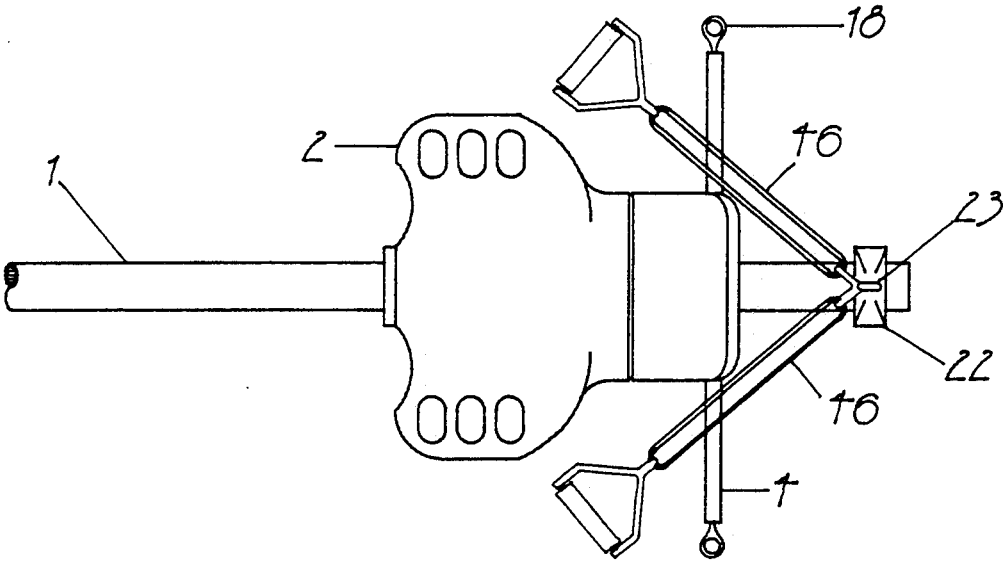
FIG. 17 is a fragmentary top view of the seat and center pole with the rear arm tension elastic cords.
Figure 19:
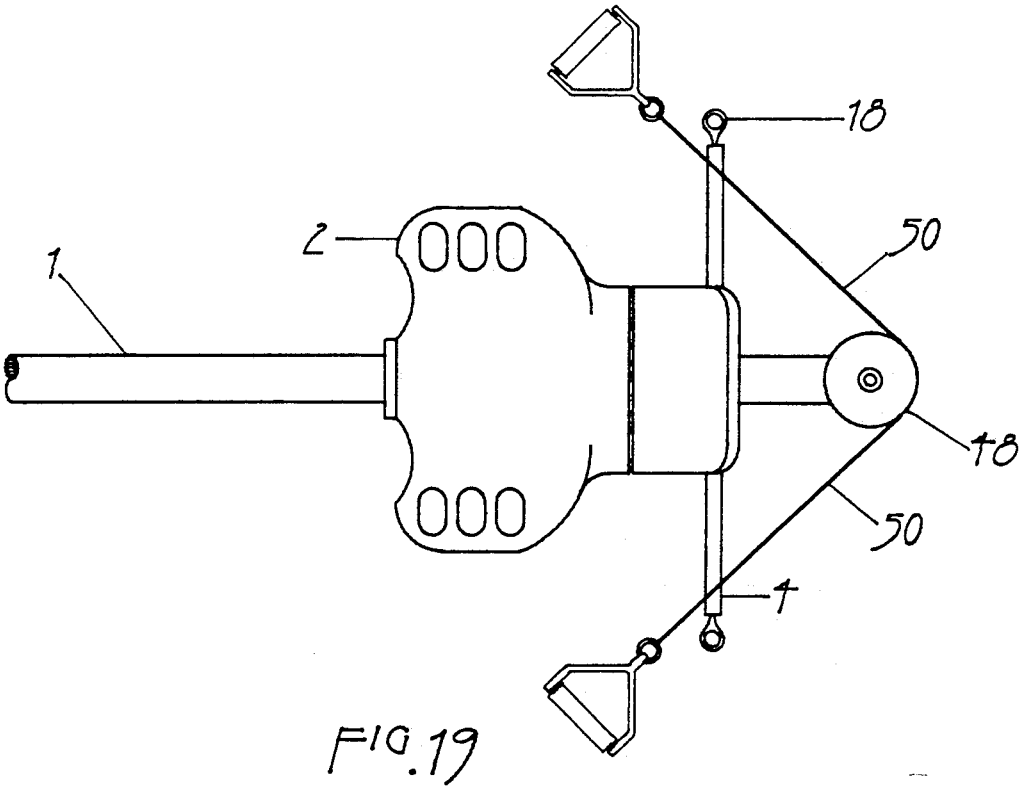
FIG. 19 is a fragmentary top view of the seat and center pole with the rear pulley and cable.

FIG. 12 shows how the device can be configured to obtain yet another form of exercise. In this configuration the rear arm tension elements 26 are attached to the rear support lock and spring catch 23. The rear support lock and spring catch 23 affixes the rear support bracket 22 to the center post 1. Here the exerciser sits in seat 2 and pulls forward upon the handles connected to the rear arm tension element 26, thus giving the opposite type of resistance that is found in the rowing exercise. The rear arm tension element 26 is shown as a spring in FIG. 12, but in an alternate embodiment of this invention this element can be an elastic cord 46 as shown in FIG. 17. FIG. 19 provides yet another alternate method using a rear pulley 48 and rear cable 50.

I claim:

1. A combination sit-up, rowing, arm, leg, foot exercise device comprising:

a center pole with front and rear ends and top and bottom surfaces having a plurality of holes along the top surface and a corresponding plurality of holes along the bottom surface;

a seat with a front edge, two side edges, rear edge, and top and bottom surfaces rigidly attached to the center pole; a seat spring catch rigidly mounted to each side edge of the seat;

a plurality of seat rocker legs attached to the bottom surface of the seat;

a plurality of telescoping legs mounted perpendicularly to the seat bottom surface;

a seat back with a bottom edge and a top edge with the bottom of the seat back mounted to the rear edge of the seat with a hinge joint;

a seat cross pole with two ends removably mounted to the top edge of the seat back;

a seat cross pole spring catch mounted to each end of the rear seat cross pole;

a plurality of sit-up assist elements with two ends each end having a hook, one hook engaging the seat catch and the other hook engaging a corresponding seat cross pole catch; a rear accessory catch rigidly mounted to the back of the seat back;

a foot cross pole bracket engaging the center pole such that the foot cross pole bracket may transverse along the center pole in the lengthwise direction;

a foot cross pole with two ends rigidly attached to the foot cross pole bracket such that the foot cross pole is perpendicular to the center pole;

a foot cross pole bracket spring catch rigidly mounted to the foot cross pole bracket;

a foot cross pole bracket lock rigidly fixing the foot cross pole bracket to the center pole using one of the holes in the top and bottom surface of the center pole;

a center foot cross pole spring catch rigidly mounted to the foot cross pole bracket;

a center pole spring catch removably mounted to the center pole using one of the plurality of holes contained in the center pole between the seat and the foot cross pole bracket;

a leg tension elements attached to the center pole spring catch and the center foot cross pole spring catch;

a plurality of foot treadles with top and bottom ends pivotably mounted to the foot cross pole;

a foot treadle spring catch mounted on the bottom end of the foot treadle;

a front leg mounted to the center pole at the front end of the center pole;

a front leg spring catch mounted to the front leg;

a plurality of foot treadle tension elements with two ends, each end having a hook, one hook engaging the front leg spring catch and the other hook engaging a foot treadle spring catch;

a plurality of rowing tension elements with two ends, one end having a hook and the other end having a handle for grasping, the hook end of the rowing tension elements engaging the corresponding foot cross pole spring catch;

a rear support bracket removably attached to the center pole;

a rear support catch and lock which secures the rear support bracket to the center pole using the holes in the center pole;

a seat support arm which attaches to the rear support catch and the rear support bracket a plurality of seat back tension elements mounted to the seat spring catch at one end and at the other end mounted to the rear support lock and spring catch.

a body belt consisting of two sections each with two ends, one end of each section attached to the seat back and a means for coupling the other ends to one another;

a plurality of rear arm tension elements attached to the rear support lock and spring catch.

2. The same device as claimed in claim 1 wherein the seat back tension elements connect from the cross pole to the back center fixture.

3. The same device as claimed in claim 1 wherein the seat back is curved inward at the bottom to support the lumbar spine, outward to support the thoracic area, and inward again to provide neck and head rest/support and may have a cutout for coccyx comfort.

4. The device as claimed in claim 1 wherein the seat back tension element connects from the set cross pole to the rear support catch and spring catch.

5. The device as claimed in claim 1 wherein the rowing tension element is connected to the foot cross pole bracket spring catch.

6. The device as claimed in claim 1 wherein the sit-up assist elements are springs.

7. The device as claimed in claim 1 wherein the sit-up assist element are elastic cords.

8. The device as claimed in claim 1 wherein the foot treadle tension elements are springs.

9. The device as claimed in claim 1 wherein the foot treadle tension elements are elastic cords.

10. The device as claimed in claim 1 wherein the rowing tension elements are springs.

11. The device as claimed in claim 1 wherein the rowing tension elements are elastic cords.

12. The device as claimed in claim 1 wherein the rowing tension elements are pulley and cable.

13. The device as claimed in claim 1 wherein the seat back tension elements are springs.

14. The device as claimed in claim 1 wherein the seat back tension elements are elastic cords.

15. The device as claimed in claim 1 wherein the rear arm tension elements are springs.

16. The device as claimed in claim 1 wherein the rear arm tension elements are elastic cords.

17. The device as claimed in claim 1 wherein the rear arm tension elements are pulley and cable.

18. The device as claimed in claim 1 wherein the leg tension element is a spring.

19. The device as claimed in claim 1 wherein the leg tension element is an elastic cord.

* * * * *